US008794148B2

(12) United States Patent
Baureis et al.

(10) Patent No.: US 8,794,148 B2
(45) Date of Patent: Aug. 5, 2014

(54) PRINTING PRESS

(75) Inventors: Martin Baureis, Horrenberg (DE); Bernhard Buck, Heidelberg (DE); Siegfried Kurtzer, Edingen-Neckarhausen (DE); Stefan Mutschall, Östringen (DE); Henning Niggemann, Dossenheim (DE); Malte Seidler, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 683 days.

(21) Appl. No.: 12/358,822

(22) Filed: Jan. 23, 2009

(65) Prior Publication Data

US 2009/0183646 A1 Jul. 23, 2009

(30) Foreign Application Priority Data

Jan. 23, 2008 (DE) ..... 10 2008 005 632

(51) Int. Cl.
*B41F 13/36* (2006.01)

(52) U.S. Cl.
CPC ..... *B41F 13/36* (2013.01)
USPC ..... 101/480; 101/145

(58) Field of Classification Search
USPC ..... 101/144, 145, 480
See application file for complete search history.

(56) References Cited

U.S. PATENT DOCUMENTS 3,012,717 A 12/1961 Sobisch et al.
4,483,249 A * 11/1984 Iwao et al. ..... 101/93.3
4,492,160 A * 1/1985 Clark et al. ..... 101/71
4,854,236 A * 8/1989 Thunker et al. ..... 101/411
5,080,347 A * 1/1992 Funada ..... 271/266
5,321,687 A * 6/1994 Kinoshita et al. ..... 720/621
5,456,128 A * 10/1995 Thunker ..... 74/53
6,156,158 A 12/2000 Kustermann (Continued)

FOREIGN PATENT DOCUMENTS

DE 231275 C 2/1911
DE 1153923 B 9/1963

(Continued)

OTHER PUBLICATIONS

M. Berger, et al: "Hybride Antriebssysteme zur Erzeugung Veränderlicher Übertrangungs-und Führungsbewegungen", In: VDI Berichte Nr. 1963, pp. 631-642, Düsseldorf, VDI-Verlag 2006. Statement of Relevance.

(Continued)

*Primary Examiner* — David Banh
(74) *Attorney, Agent, or Firm* — Laurence A. Greenberg; Werner H. Stemer; Ralph E. Locher

(57) ABSTRACT

A printing press includes an assembly and a cam mechanism for moving at least one part of the assembly. A cam of the cam mechanism has a curvature course with points, in particular bends or jumps, which are not constantly differentiable within a movement region of the cam. The cam mechanism can include an actuator for the temporal displacement of jolts which are induced by the points that are not constantly differentiable to the at least one part of the assembly. An adaptation of the movement which is produced to the operating state of the printing press is possible, with the result that a considerable reduction can be achieved in vibrations for all printing speeds.

7 Claims, 7 Drawing Sheets

(56) References Cited

U.S. PATENT DOCUMENTS

| | | | | |
|---|---|---|---|---|
| 6,254,778 | B1 | 7/2001 | Chudoba et al. | |
| 6,311,617 | B1 | 11/2001 | Herden et al. | |
| 6,349,935 | B1 | 2/2002 | Boguhn et al. | |
| 6,401,620 | B1 | 6/2002 | Buck et al. | |
| 6,672,357 | B2 * | 1/2004 | Yokozawa et al. | 156/540 |
| 6,840,170 | B2 | 1/2005 | Becker et al. | |
| 6,938,515 | B2 | 9/2005 | Glöckner et al. | |
| 7,017,483 | B2 | 3/2006 | Bolza-Schünemann | |
| 7,040,225 | B2 | 5/2006 | Bolza-Schünemann | |
| 2003/0010150 | A1 | 1/2003 | Glockner et al. | |
| 2003/0226458 | A1 * | 12/2003 | Becker et al. | 101/216 |
| 2005/0081728 | A1 | 4/2005 | Bolza-Schünemann | |
| 2006/0130791 | A1 * | 6/2006 | Lee | 123/90.18 |
| 2006/0288892 | A1 * | 12/2006 | Forch et al. | 101/232 |
| 2007/0214975 | A1 * | 9/2007 | Held | 101/56 |
| 2007/0221086 | A1 | 9/2007 | Buck et al. | |
| 2008/0022875 | A1 | 1/2008 | Hirokawa et al. | |

FOREIGN PATENT DOCUMENTS

| | | | | | |
|---|---|---|---|---|---|
| DE | 19610466 | A1 | | 9/1997 | |
| DE | 19652769 | A1 | | 6/1998 | |
| DE | 19831976 | A1 | | 1/2000 | |
| DE | 19914627 | A1 | | 10/2000 | |
| DE | 20011948 | U1 | | 12/2000 | |
| DE | 19963945 | C1 | | 7/2001 | |
| DE | 10107135 | A1 | | 8/2002 | |
| DE | 10320760 | A1 | | 12/2003 | |
| DE | 10335621 | A1 | | 3/2004 | |
| DE | 19940532 | B4 | | 2/2007 | |
| DE | 102006013752 | A1 | | 9/2007 | |
| DE | 102007034302 | A1 | | 1/2008 | |
| GB | 2311037 | A | | 9/1997 | |
| JP | 2000062933 | A | * | 2/2000 | B65G 35/00 |
| WO | 03064763 | A1 | | 8/2003 | |

OTHER PUBLICATIONS

R. Braune: "Koppelgetriebe mit Servo-Antrieb in Schnellen Verarbeitungsmaschinen", In: Tagungsband zur Tagung Verarbeitungsmaschine und Verpackungstechnik Technische Universitat, Dresden 2006. Statement of Relevance.

Nutzungspotentiale und Konzipierungsgaspekte; In: Tagungsband zur VDI/VDE-Tagung Elektrisch-Mechanische Antriebssysteme in Fulda 2004, Düsseldorf, VDE-Verlag 2004. Statement of Relevance.

B. Corves, et al: "Methoden zum Entwurf Mechatronischer Bewegungssysteme mit Ungleichmässig Übersetzenden Getrieben", In VDI-Berichte Nr. 1963, pp. 557-573, Düsseldorf, VDI-Verlag 2006. Statement of Relevance.

VDI 2143, Bewegungsgesetze für Kurvengetriebe, pp. 1-3. Statement of Relevance.

* cited by examiner

PRINTING PRESS

CROSS-REFERENCE TO RELATED APPLICATION

This application claims the priority, under 35 U.S.C. §119, of German Patent Application DE 10 2008 005 632.4, filed Jan. 23, 2008; the prior application is herewith incorporated by reference in its entirety.

BACKGROUND OF THE INVENTION

Field of the Invention

The invention relates to a printing press having an assembly and a cam mechanism for moving at least one part of the assembly.

In order to produce movements in printing presses, in particular sheet-fed printing presses, positive mechanisms with a non-uniform transmission ratio such as cam mechanisms, coupler mechanisms or combination of those mechanisms are used at many locations. Non-uniform movements in sheet-fed printing presses are, for example, the front lay or front guide movement and the pull-type lay movement, the swinging movement of the pregripper or the closing movements and opening movement of the gripper systems. The positive mechanisms with a non-uniform transmission ratio are usually coupled fixedly to the uniformly running main drive of the machine. Mechanisms of that type meet the high requirements for accuracy of movement and process speed with high reliability. However, the forces and inertial forces which are introduced during the course of the movement excite frequently disruptive vibrations of the assemblies or of the working elements, for example gripper systems. In that case, the magnitude of the vibration amplitudes which occur depends substantially on the transmission function of the mechanism with a non-uniform transmission ratio which is used, in particular on the configuration of the cam disks in the case of cam mechanisms, and on the operating state of the printing press, in particular on the printing speed of the printing press.

However, the advantages of high movement precision and the realization of a high process speed and process reliability of mechanisms with a non-uniform transmission ratio are seen alongside a low flexibility of the movement which is produced. For example, the transmission behavior of a cam mechanism is fixed by the configuration of the cam, in particular on a cam disk. Flexible adaptation of its transmission function to different operating states of the printing press, in particular for the purpose of reducing the vibrations of the system, is not possible at the same time that the drive of the cam disk is rotating.

In general, there is provision in the construction and configuration of cam mechanisms for the VDI Guideline 2143 to be taken into account. In Guideline 2143 (see VDI-EKV: Guideline 2143, Bewegungsgesetze für Kurvengetriebe [Laws of Motion for Cam Mechanisms], Berlin, Cologne: Beuth Verlag 1980), mathematical principles are described for calculating favorable transmission functions of the $0^{th}$ to $2^{nd}$ order for cam mechanisms. The cams can have a plurality of movement regions, that is to say a plurality of sections can exist on the cam with transmission functions which are different from one another or transmission functions which are set against one another in pieces. In that case, the transmission function of the $0^{th}$ order is the functional relationship between the drive angle (in particular, rotational angle of the cam disk, angle $\phi_1$) and the output angle or the output path (in particular, rotational angle of a roller lever, angle $\psi_1$) of a cam mechanism. The transmission functions of the $1^{st}$ and $2^{nd}$ orders are the corresponding derivations $d\psi_1/d\phi_1$ and $d^2\psi_1/d\phi_1^2$. According to the Guideline, expressly only configurations of the output movement of a cam mechanism with a constant transmission function of the $2^{nd}$ order are recommended as being favorable in vibration terms. According to Guideline 2143, the mathematical description of the corresponding transmission function of the $0^{th}$ order takes place with the use of suitable polynomial functions or trigonometric functions. In high speed cam mechanisms, as are used in printing presses, corresponding laws of motion frequently lead to a great excitation of vibrations of the mechanical system.

A further prevalent method for configuring favorable transmission functions is harmonic synthesis, that is to say the representation of the transmission function of the $0^{th}$ order of a cam mechanism as the sum of harmonic proportions (sum of sine and cosine functions). Laws of motion of that type are also denoted HS (High Speed) laws of motion in the literature. In that case, the highest frequency of the harmonic proportions of an HS law of motion lies considerably below the resonant frequencies of the driven mechanical system, for example a cam controlled gripper shaft in a printing press. The corresponding resonant frequencies are therefore excited only to a small extent, with the result that vibrations of the driven system can be reduced effectively in many cases. However, HS laws of motion have the disadvantage, as a result of their principle, that no exact resting phases (phases with a stationary output element of the cam mechanism) can be produced in the course of movement of the output element. However, low vibration movements with resting phases are frequently required in printing presses.

A further possibility for producing low vibration movements is the combination of mechanisms with a non-uniform transmission ratio (cam mechanisms and coupler mechanisms, and combinations thereof) with at least one electronic drive.

For example, in the article "Hybride Antriebssysteme zur Erzeugung Veränderlicher Übertragungs-und Führungsbewegungen" [Hybrid Drive Systems for Producing Variable Transmission and Guiding Movements] by M. Berger and J. Matthes (VDI-Berichte No. 1963, pages 631-642 Düsseldorf, VDI-Verlag 2006), hybrid mechanisms are described for producing movements with a temporally variable movement course of the output movement. Whereas the relationship between the drive variable $\phi$ (for example, the angular position of a cam disk which rotates uniformly) and the output variable $\psi_1$ (for example, the angular position of a roller lever which works with the cam disk) is fixed in the case of positive mechanisms with a non-uniform transmission ratio, the corresponding function $\psi_1(\phi_1)$ can be varied within limits in that case. The mechanisms which are described are based in each case on flat five link kinematic chains having the degree of freedom 2, in which the output movement is produced by two drive movements which are independent of one another. Accordingly, the mechanisms have a uniformly rotating main drive and an electronically controlled adjusting drive, by way of which it is possible to influence the output movement of the mechanism within limits in a targeted manner. The number of mechanism elements and joints is also increased by way of the mechanism degree of freedom in comparison with mechanisms having a single drive. As a result thereof, firstly the structural complexity increases and additional compliances and bearing plays are likewise produced in some circumstances, which can have a negative influence on the dynamic behavior of the system.

Various publications also describe mechanisms with a non-uniform transmission ratio (cam mechanisms and coupler mechanisms) which are driven by a single, electronically controlled motor. The following can be mentioned by way of example: Braune, R. "Koppelgetriebe mit Servo-Antrieb in schnellen Verarbeitungsmaschinen" [Coupler Mechanisms having a Servodrive in High Speed Processing Machines] in the congress volume for the congress on processing machines and packaging technology, Technical University Dresden 2006, Callesen, M. and Braune, R. "Kombination von gesteuerten Antrieben mit Koppelgetrieben—Nutzungspotentiale und Konzipierungsaspekte" [Combination of Controlled Drives having Coupler Mechanisms—Potential Uses and Design Aspects] in the congress volume for the VDI/VDE congress on electrical/mechanical drive systems in Fulda 2004, Düsseldorf, VDE-Verlag 2004 and Corves, B., Abel, D., Plesken, W., Harmeling, F., Robertz, D. and Maschuw, J. "Methoden zum Entwurf mechatronischer Bewegungssysteme mit ungleichmaäβig übersetzenden Getrieben" [Methods for Designing Mechatronic Movement Systems with Mechanisms having a Non-Uniform Transmission Ratio] in VDI-Berichte No. 1963, pages 557-573, Düsseldorf, VDI-Verlag 2006. Cam mechanisms or coupler mechanisms usually have uniformly rotating drive motors. The desired output movement with a non-uniform movement course is achieved in the case of cam mechanisms by a corresponding configuration of the cam disks and in the case of coupler mechanisms by the positional dependence of their transmission ratio. The above-mentioned publications eliminate the limitation of a constant angular speed of the drive motor and use controlled or regulated motors to drive cam mechanisms or coupler mechanisms. In particular, the drive motor can also be regulated with the aim of minimizing disruptive vibrations. In that case, the drive motor is operated in a closed regulating loop with corresponding expenditure. When configurations of that type are used in printing presses, it is to be taken into consideration, in particular, that a multiplicity of part functions and movements have to run in that case in a coordinated manner with high process reliability. That is achieved in modern printing presses by the use of a single, central main drive for the part functions (for example, front lay movement and pull-type lay movement, pregripper movement, rotary movement of the cylinders, gripper control). If decentralized drive concepts are used (controlled or regulated individual drives of the part functions), the coordinated movement sequence cannot be achieved with the same reliability in every case. Emergency stop situations (possibly in conjunction with a power failure) can be cited as examples in that case, in which the correct control or regulation of the individual drives which are used is ensured only to a limited extent.

In printing presses, piezoelectric actuators are frequently used as actuators in order to realize as low a vibration movement of the drive element or an assembly as possible. In particular, the following publications are to be cited in this context.

German Published, Non-Prosecuted Patent Application DE 103 35 621 A1 describes a general method for actively influencing vibrations in sheet-fed printing presses with the aid of piezoelectric actuators. In that case, the vibrating component, for example a gripper or a gripper shaft, is provided directly with a piezoelectric actuator. Forces which counteract disruptive vibrations can be superimposed onto the system by suitable actuation of the actuator.

German Published, Non-Prosecuted Patent Application DE 200 11 948, German Published, Non-Prosecuted Patent Application DE 196 52 769 A1, corresponding to U.S. Pat. Nos. 6,156,158 and 6,419,794, International Publication No. WO 03/064763 A1, corresponding to U.S. Pat. Nos. 7,017,483 and 7,040,225, and German Published, Non-Prosecuted Patent Application DE 101 07 135 A1 propose the use of active mountings for influencing vibrations. In that case, the bearings of rotors, for example the bearings of the cylinders of a printing press, are provided with actuators. In that way, the bearings can be moved in each case perpendicularly with respect to the rotational axis of the rotor. Vibrations of the rotor, for example bending vibrations of a printing form cylinder, a blanket cylinder and an impression cylinder, or vibrations of the contact forces between cylinders which roll on one another, can be reduced by suitable actuation of the actuators. Those displacements of the bearing points which are required for that purpose are generally small, with the result that piezoelectric actuators are also proposed in those applications.

German Patent DE 199 63 945 C1, corresponding to U.S. Pat. No. 6,938,515, describes the integration of piezoelectric actuators into the rotating cylinders of printing presses. The cylinders can be deformed in a targeted manner with the aid of the actuators. Disruptive deformations which occur during operation as a result of vibrations are compensated for at least partially by suitable actuation of the actuators.

German Published, Non-Prosecuted Patent Application DE 198 31 976 A1, corresponding to U.S. Pat. No. 6,349,935, describes a drive for a pregripper of a sheet-fed printing press. In that case, the cyclical movement of the pregripper is produced by the superimposition of the movement of a cam mechanism and a controlled actuator, in particular for correcting movement errors. In that case, in particular, the use of piezoelectric actuators is also proposed.

In the case of active vibration reduction, forces which counteract the vibrations of the working element are superimposed onto an oscillatory system in a targeted manner with the aid of suitable actuators. Due to their high dynamics, piezoelectric actuators, in particular, can be used in many cases for producing the corresponding force signals. In corresponding technical configurations, the actuator is operated in a closed regulating loop, in which the vibration which is to be counteracted is measured and converted into a corresponding signal for actuating the actuator. In particular, the vibration reducing effect is canceled completely if the actuator is not actuated.

SUMMARY OF THE INVENTION

It is accordingly an object of the invention to provide a printing press, which overcomes the hereinafore-mentioned disadvantages of the heretofore-known devices of this general type and which produces a reduced vibration movement of at least one part of an assembly of a printing press.

With the foregoing and other objects in view there is provided, in accordance with the invention, a printing press, in particular a sheet-fed printing press and/or an offset printing press, comprising an assembly and a cam mechanism for moving at least one part of the assembly. The cam mechanism includes a cam having a movement region and a curvature course with points not being constantly differentiable within the movement region.

In this way, a pronounced reduction or up to a complete elimination of disruptive vibrations can be achieved, in particular with points in the curvature course of the cam disk profile, in which the points are not constantly differentiable and are adapted specifically to the resonant vibration behavior of the assembly.

The movement can be non-uniform, in particular. The movement can be periodic and/or cyclical, in particular. The cam mechanism can be positive and/or have a non-uniform transmission ratio. The curvature course can (preferably) be the second derivation or a higher derivation than the second derivation of the cam course. According to the invention, the curvature course can, in particular, be the curvature or the bump. In other words, the curvature course can have points, at which the curvature of the cam, which curvature is expressed as a function, is not constant or not differentiable in the context of infinitesimal calculus or mathematical analysis of the cam. In particular, the position of the points can be coordinated with or adapted to the resonant vibration behavior of the driven assembly. The cam mechanism can be a cam mechanism in the actual meaning of that expression, or can be a cam mechanism which is combined with further mechanism elements, in particular with a coupler mechanism. The cam mechanism can be part of a drive system, in particular of a drive system for an assembly of a printing press. The assembly can be a working element of an apparatus of the printing press or a component of the printing press.

In accordance with another feature of the invention, in the printing press according to the invention, the points or locations which are not constantly differentiable can be bends or jumps in the curvature course of the cam. However, the bends or jumps in the curvature course are equivalent to corresponding bends or jumps in the transmission function of the $2^{nd}$ order or in the transmission function which is higher than the $2^{nd}$ order. In other words, the printing press according to the invention includes a cam mechanism with a transmission function which is not constant or is not differentiable of the $2^{nd}$ order or higher. As an alternative to a cam disk configuration with jumps in the cam curvature, that is to say jumps in the transmission function of the $2^{nd}$ order of the cam mechanism (which corresponds to the angular acceleration profile of a roller lever), jumps can also be provided in the transmission functions of a higher order with the aim of a targeted vibration excitation of the driven system (excitation of a compensating vibration of a working element). In particular, jumps in the transmission function of the $2^{nd}$ order of a cam mechanism correspond to jumps in the curvature course of the corresponding cam disk profile. In the case of jumps in the transmission function of the $3^{rd}$ order (bump function), cam disk profiles are produced with bends in the curvature course. In other words, if jumps in the transmission function of the $3^{rd}$ order of the cam mechanism (which corresponds to the bump course of a roller lever) are provided, cam disks are produced with bends in the profile curvature.

In accordance with a further preferred feature of the invention, the cam is the peripheral line of a cam disk or a cam disk contour. In other words, the cam is formed on a cam disk, in particular a closed and/or cyclical and/or periodic cam.

The cam mechanism according to the invention can be used in principle to realize any desired non-uniform movements in the printing press according to the invention. The following application fields are expedient, in particular: front lay or front guide drive, pregripper drive, gripper control, integration of actuators into tooth segments of a turning drum.

In accordance with an added feature of the invention, it is particularly advantageous if, in one embodiment of the printing press, the cam mechanism includes an actuator for the temporal displacement of jolts which are induced by the points, in particular bends and jumps, which are not constantly differentiable, to the at least one part of the assembly. The actuator can, in particular, be controlled, electronically controlled or electronically regulated. The cam mechanism and the actuator together can be called a drive system. In particular, the actuator can be a piezoelectric actuator which is connected to a roller lever that is controlled by the cam. The piezoelectric actuator can be integrated into a coupler of the output train or act on a coupler of the output train. Furthermore or as an alternative thereto, there can be provision for the printing press according to the invention to have a control unit, by way of which the actuator can be actuated as a function of the printing speed. For example, the control unit can be the general machine control device.

In these advantageous embodiments, the movement which is produced can be adapted within certain limits to the operating state of the printing press. A considerable reduction in vibrations can be achieved for all printing speeds. The increased structural expenditure is slight.

As an alternative to piezoelectric actuators, electrodynamic actuators can be used, in particular electric motors and linear electric motors. This use according to the invention requires actuators with high dynamics and a high power density with a comparatively small actuator travel. Piezoelectric actuators meet these requirements in a particularly advantageous way.

Some embodiments of the printing press according to the invention can have a main drive, from which a substantial part of the energy for producing all movement forms is tapped and which also defines synchronous running of the machine cycle. In accordance with an additional feature of the invention, the cam mechanism can also be coupled to the main drive of the printing press. As a result, in particular, process reliability for possible failure of the optionally used actuators or their controllers or regulating devices is achieved in an advantageous way. Even if it has a less favorable vibration behavior, the cam mechanism according to the invention remains functional without a risk of collisions.

In accordance with yet another, particularly preferred feature of the invention, those points of the curvature course which are not constantly differentiable lie on the cam in such a way that vibrations of the part of the assembly are reduced or compensated for in resting phases of the movement of the part. The resting phase is defined as a phase or a time interval with a stationary driven part of the assembly, in particular with a stationary output element or output train of the cam mechanism.

In accordance with yet a further, particularly preferred feature of the invention, as an alternative thereto, two points of the curvature course which are not constantly differentiable lie on the cam at a spacing which is passed through during a multiple of half the vibration duration of the assembly when the cam is sensed by way of a cam follower with a relative movement with respect to the cam at the delivery speed of the cam. For the case of even multiples, in comparison with the situation with odd multiples, there is a jolt with inverted amplitude at the second point which is not constantly differentiable, in order to achieve a comparable situation.

In accordance with yet a concomitant, concrete embodiment of the invention, the printing press is a sheet-fed printing press, in particular a multi-color sheet-fed printing press, and the assembly is a front lay or front guide mechanism for bringing sheets into contact with a first printing unit. A simple three link cam mechanism can advantageously be used as a basic mechanism for the front lay mechanism. In this way, flexibility, compliance or yielding is not increased and an additional bearing play is avoided.

Other features which are considered as characteristic for the invention are set forth in the appended claims.

Although the invention is illustrated and described herein as embodied in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE SEVERAL VIEWS OF THE DRAWING

DETAILED DESCRIPTION OF THE INVENTION

Figure 1:
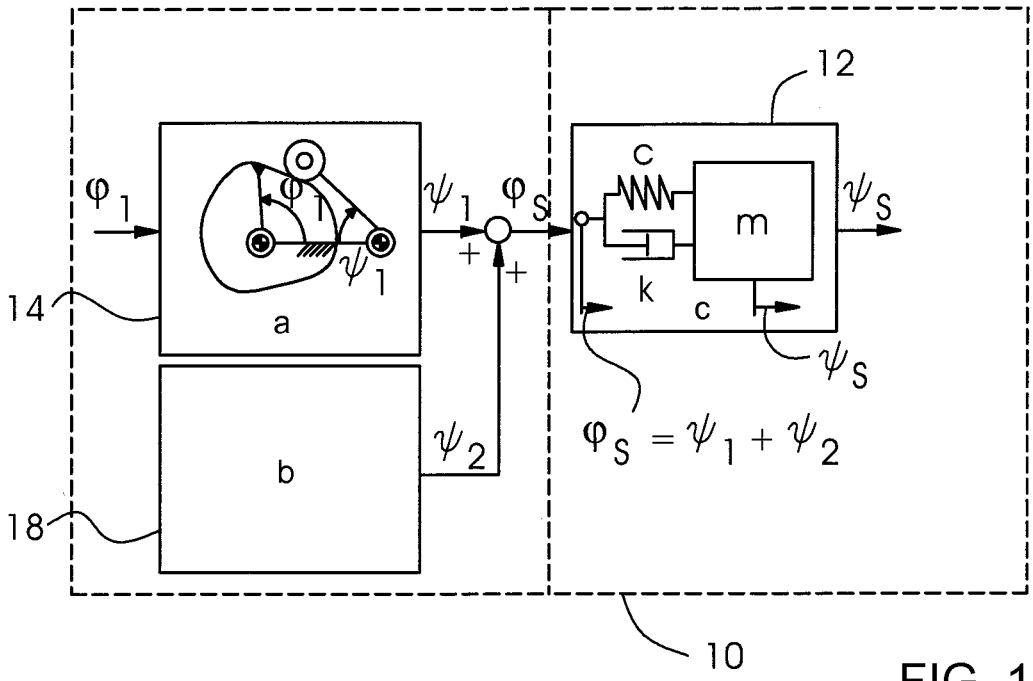
FIG. 1 is a diagrammatic and schematic illustration of a drive system for superimposing a cam controlled movement with a non-constant acceleration profile (cam disk with a non-constant curvature course) and a movement of an electronically controlled actuator.
Figure 2:
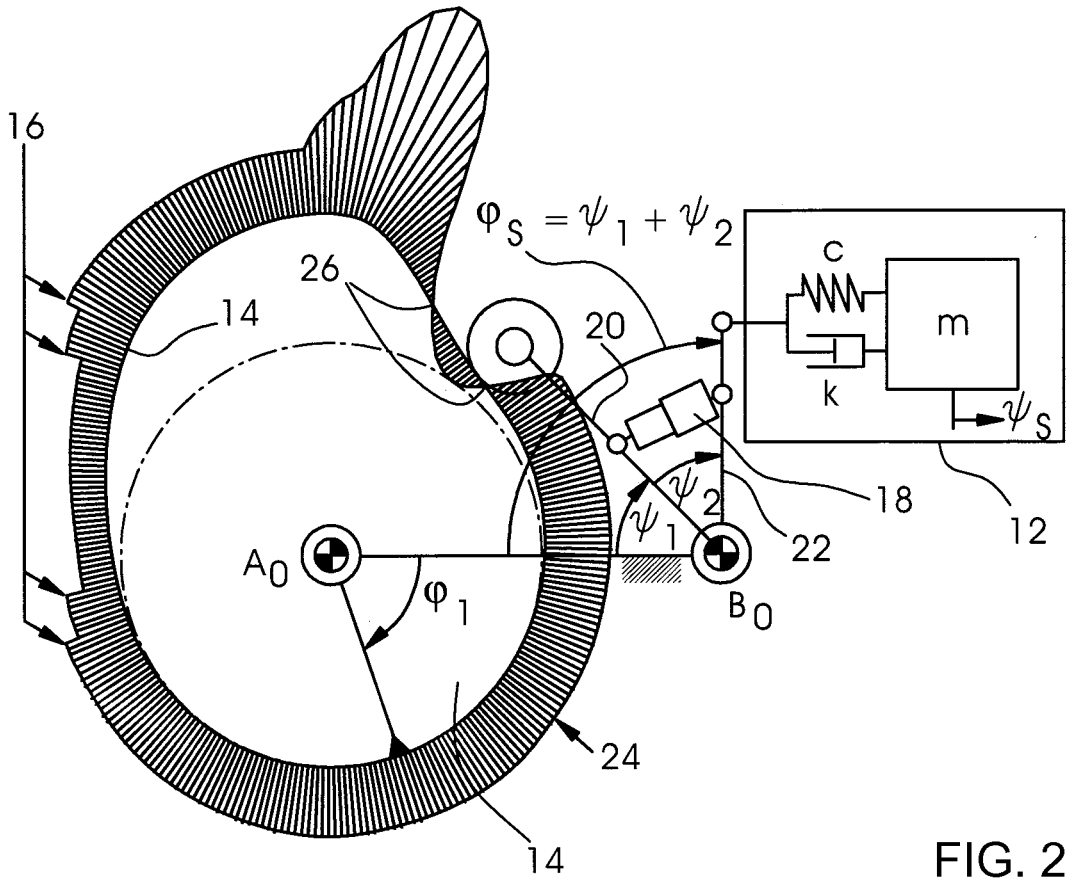
FIG. 2 is an enlarged, diagrammatic and schematic illustration of one advantageous embodiment of the drive system.

Referring now to the figures of the drawings in detail and first, particularly, to FIG. 1 thereof, there is seen a diagrammatic and schematic illustration of a drive system for superimposing a cam controlled movement with a non-constant acceleration profile (cam disk with a non-constant curvature course) and a movement of an electronically controlled actuator, as can be used in embodiments of a printing press 10 according to the invention. The printing press 10 according to the invention has an assembly 12 to be driven, which is understood in the following text to be an oscillatory mechanical system, more precisely to be a vibrator having a mass m, a rigidity c and a damping constant k and having an input variable $\phi_s$ and an output variable $\psi_s$ in a part c of the system of FIG. 1). Concrete exemplary embodiments are a front lay mechanism and top lay mechanism, a pregripper system or a gripper system on an impression cylinder or a transfer cylinder. In a cam controlled gripper system for paper sheets, which is customary in printing presses 10, a rotary angle of a gripper shaft at a drive end could be defined, for example, as the input variable $\phi_s$ and the orientation of the grippers as the output variable $\psi_s$ which is relevant in terms of printing technology. In one advantageous development of the invention, the printing press 10 according to the invention includes a drive system for the assembly 12 or a working element which has a cam mechanism for the main drive of the assembly 12 (in a part a of the system of FIG. 1) and an electronically controlled actuator 18 (in a part b of the system of FIG. 1). According to the invention, a cam disk 14 has, as a particular characterizing feature, at least one and preferably a plurality of jumps or bends in a curvature course of its contour, which is also called a cam disk with a non-constant curvature. The jumps and bends are configured according to size and location on the cam disk in such a way that vibrations of the driven working element of the printing press 10 (oscillations in the temporal course of the variable $\psi_s$ in FIG. 1) are reduced or are even eliminated completely in the case of an optimum configuration and adaptation to an operating state of the printing press. The electronically controlled actuator 18, the movement of which is superimposed on the output movement of the cam mechanism, serves for flexibly adapting the temporal course of the variable $\phi_s$ (input variable of the system which is to be driven in FIG. 1) to the operating state of the printing press, for example to a printing speed. FIG. 2 diagrammatically shows one preferred embodiment of the drive system.

In comparison with cam mechanisms and coupler mechanisms with conventional configurations, the drive system or cam mechanism of the printing press 10 according to the invention, which is shown in FIGS. 1 and 2, uses the at least one cam disk 14 with locations or points in the form of jumps 16 in the curvature course. The size and location of the jumps 16 on the cam disk profile are calculated and realized on the cam disk in such a way that vibrations of the driven assembly 12 can be reduced considerably even without the use of an active element (controlled or regulated actuator 18). In comparison with cam mechanisms and coupler mechanisms having an active element for vibration reduction, the electronically actuated actuator (for example, a piezoelectric actuator in FIG. 2) according to the invention serves only to improve operating behavior in as wide a range as possible of the working speed. In contrast to customary cam mechanisms or coupler mechanisms having an electronically controlled drive motor, the cam disk 14 of the mechanism according to the invention always runs at a constant angular velocity in the case of a predefined printing speed and can therefore advantageously still be coupled fixedly to the main drive of the printing press.

A movement of a swinging arm 22 is produced by superimposing the output movement of a cam mechanism and the movement of a controlled actuator 18. It is to be noted at this point that in principle all mechanisms having a degree of freedom 2, in particular five link kinematic chains, can be used to produce this movement. In contrast to combinations of cams and coupler mechanisms on the basis of five link kinematic chains, the exemplary embodiment which is shown having an active roller lever 20, in particular the direct integration which is shown in FIGS. 5 and 6, of the actuators into the lever with the use of a solid body joint, manages with a small number of components and a small number of joints.

The fundamental physical principle and further characterizing properties of the corresponding cam disk profiles and of the actuator 18 will be described in greater detail in the following text with reference to the further figures.

First of all, the basic concept of the embodiment and the working principle of the drive system in the printing press according to the invention will be described in greater detail.

Figure 3:
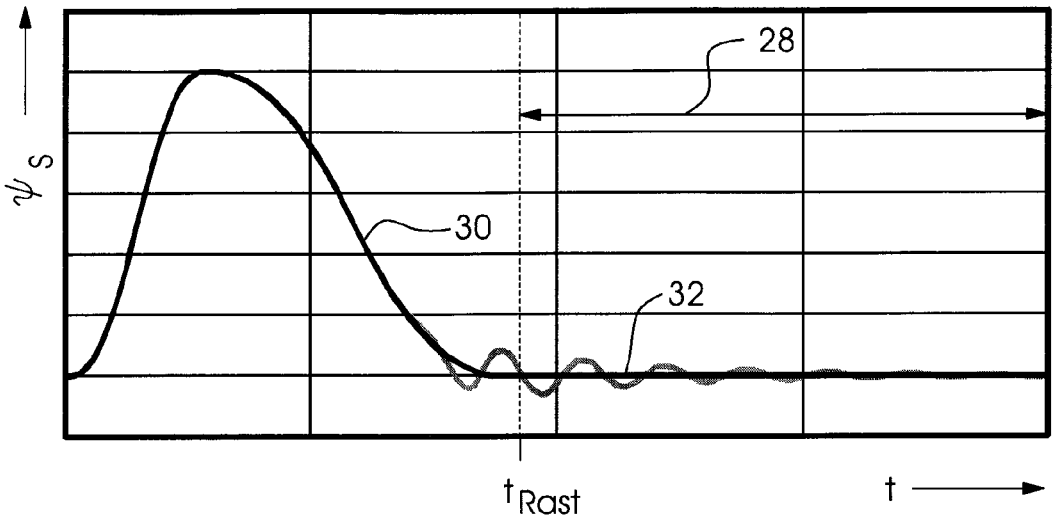
FIG. 3 is a graph showing exemplary path/time profiles for a movement of a mass m (setpoint course with exact resting phase, course with conventional cam disk configuration and decaying vibration in a resting phase)

The drive system, which is proposed herein (FIG. 2), includes first of all the uniformly rotating cam disk 14 (having a pivot point $A_0$) which is received in a machine frame and the roller lever 20 which is likewise mounted in the frame. A hodograph 24 of the cam disk curvature with the jumps 16 in the cam disk curvature and turning points 26 of the cam profile (points with a curvature 0), is also shown. The movement of the roller lever 20 is transmitted by the electronically controlled actuator 18 to the swinging arm 22 (having a pivot point $B_0$). The pivoting angle $\phi_s$ of the swinging arm 22 corresponds to the sum of the output angle $\psi_1$ of the cam mechanism and the angle $\psi_2$ between the roller lever 20 and the swinging arm 22. In this case, the angle $\psi_2$ is fixed by the stroke of the actuator 18. The swinging arm 22 moves a working element of the printing press 10 (the assembly 12, for example a gripper system, front lays or side lays). The working element is represented in FIG. 2 by an oscillatory system (single mass vibrator). A temporal profile of the pivoting angle $\phi_s(t)$ is the input variable of this system, and a temporal stroke course $\psi_s(t)$ of the mass m describes the movement of a working element of the printing press 10. The mechanism which is outlined herein by way of example is to produce a vibrating movement of the mass m with a resting phase. The corresponding course $\psi_s(t)$ is shown in FIG. 3. A variable t denotes time.

Without actuation of the actuator 18 (actuator stroke constant) and a conventional cam disk configuration, the results would be first of all undesirable vibrations of the mass m in a resting phase 28 of the cam disk 14 (FIG. 3). The cam disk 14 has jumps 16 in the curvature of its profile, as a special feature, in order to counteract these vibrations. The corresponding hodograph 24 of the curvature (reciprocal value of the curvature radius) is shown in FIG. 2. In the temporal profile of the angular acceleration $\ddot{\phi}_S=d^2\phi_s/dt^2$ of the swinging arm 22, these jumps 16 correspond to or bring about a square wave signal. FIG. 3 shows firstly an intended course 30 of the variable $\psi_s(t)$ and secondly an actual course 32 of $\psi_s(t)$ when a conventional cam disk (with a constant curvature) is used. It can be seen clearly how vibrations of $\psi_s(t)$ occur during the resting phase 28 of the cam disk 14. The beginning of the resting phase 28 is indicated by a time $t_{Rast}$.

Figure 4:
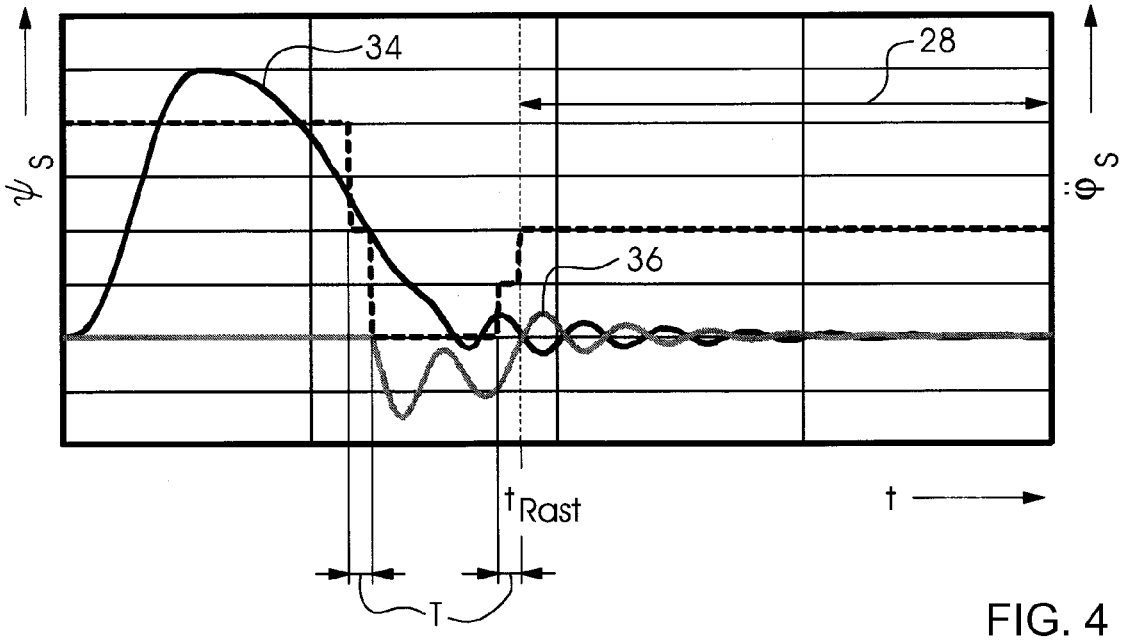
FIG. 4 is a graph showing a vibration compensated effect of jumps in the cam disk curvature in the case of a fixed delivery speed.

FIG. 4 shows a vibrational response $\psi_{s,stetig}$ (first vibrational response 34) of the mass m to a law of motion of the cam disk with a constant acceleration profile (path of the mass m in the case of a cam disk 14 with a constant curvature) and a vibrational response $\psi_{s,Rechteck}$ (second vibrational response 36) to the square wave acceleration signal, which is produced by the jumps 16 in the curvature course of the cam disk profile. It can be seen clearly that the corresponding vibrations of the mass m are identical in antiphase in the resting region 28. Furthermore, the proportion of the angular acceleration $\ddot{\phi}_s$ the roller lever 20 due to jumps in the cam disk curvature is shown. In the cam disk profile in FIG. 2, the square wave acceleration signal is superimposed on the law of motion with a constant acceleration profile. The temporal stroke course $\psi_s(t)$ of the mass m results in this case as the sum of the courses $\psi_{s,stetig}$ and $\psi_{s,Rechteck}$ shown in FIG. 4. In the resting region 28 of the cam disk, the corresponding vibrations of those courses cancel each other out, and exact resting of the mass m is achieved.

The complete freedom from vibrations of the mass m in the resting region is achieved first of all at a defined angular velocity $d\phi_{1Auslegung}/dt$ of the cam disk 14. That angular velocity can be freely selected during the mechanism configuration. It is a characteristic of the cam disk configuration that, at this delivery angular velocity, in each case at least two jumps in the curvature course of the cam disk 14 take place, offset by an integral multiple of half the transient duration of the driven mechanical system, in this case by a vibration duration T of the driven mechanical system (vibration duration of the single mass vibrator in FIG. 2). In other words, during operation of the drive system at a delivery speed (which can be selected freely within limits), in each case at least two jumps follow in the acceleration profile of the roller lever 20, offset by the transient duration of the mass m. At this delivery speed, no vibrations occur in the resting region ($t>t_{Rast}$). The controlled actuator 18 is given particular significance during operation of the cam disk 14 at an angular velocity of the cam disk 14 which is different than the delivery speed. The angular velocity can be a function, in particular, of the working speed or printing speed of the printing press. The angular velocity is frequently proportional to the printing speed, for example if the cam mechanism is coupled to the main drive of the printing press.

If the angular velocity of the cam disk 14 deviates from the delivery speed $\omega_{1Auslegung}$, the vibrations in the resting region of the output movement cannot be eliminated completely. It is an object of the controlled actuator 18 (FIG. 2) to correct the movement of the swinging arm 22 over the entire provided range of the working speed in such a way that no vibrations of the mass m occur in the resting region 28 of the output movement, which region is important in terms of process technology. For this purpose, frequently only small actuator strokes with high dynamics are required, with the result that piezoelectric actuators are advantageously used for this object.

A front lay mechanism of an offset printing press according to the invention will be described in the following text with reference to FIG. 5 to 12 as a concrete exemplary application in a printing press according to the invention.

Figure 5A:
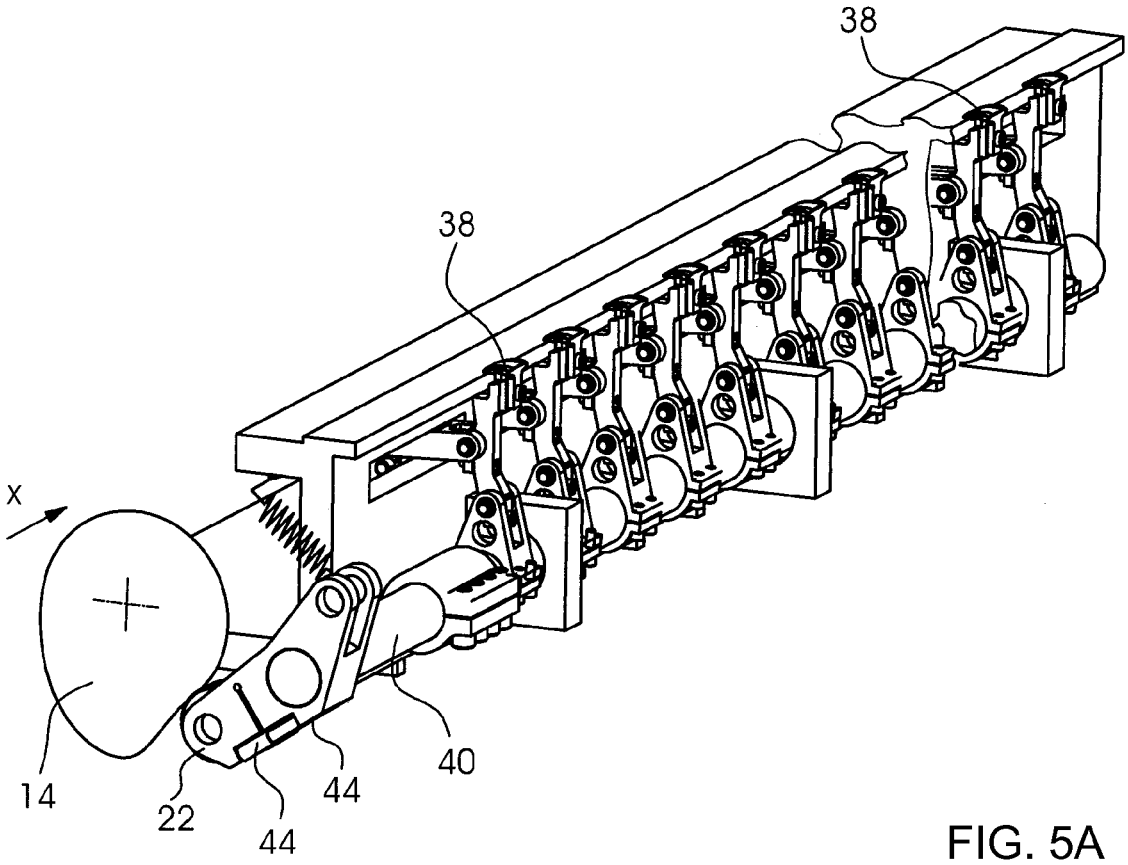
FIGS. 5A and 5B are respective perspective and side-elevational views of one advantageous embodiment of a front lay drive for a sheet-fed printing press.
Figure 5B:
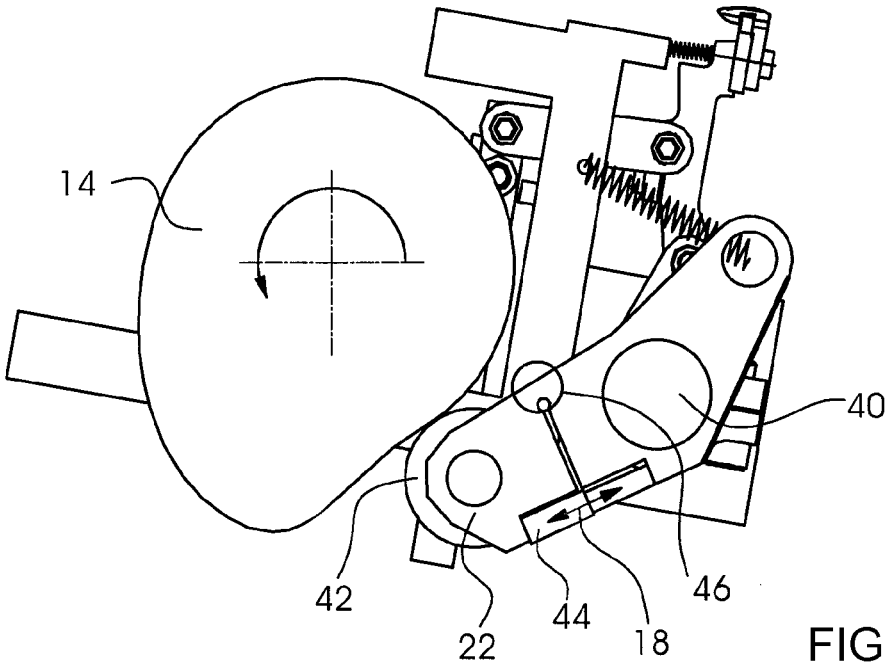

FIG. 5A shows a perspective view and FIG. 5B shows a side view of the front lay or front guide mechanism for front lays 38 with a drive system which was explained in greater detail in the preceding text. A movement of a front lay shaft 40 is produced by a flat three-element cam mechanism which has a cam disk 14 that is driven so as to rotate uniformly and a roller lever 20 with a cam roller 42. In this embodiment of the cam mechanism according to the invention, the roller lever 20 has a solid body joint 46 and is provided with two linear actuators 44 (one actuator would be sufficient for the principle achievement of the function, but two actuators are used in the present example for reasons of symmetry). They are preferably configured as piezoelectric stack actuators. The cam disk 14 is connected fixedly to a non-illustrated main drive of the printing press and rotates at a constant angular velocity in the case of a predefined printing speed. The electronically controlled linear actuators 44 serve as auxiliary drives to impart an additional rotational movement to the front lay shaft 40.

Figure 6A:
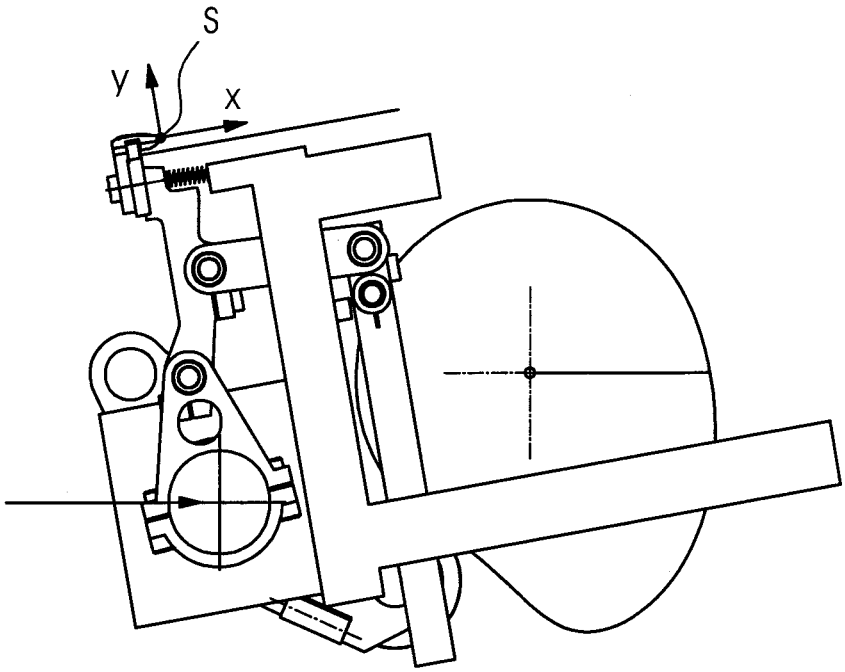
FIGS. 6A and 6B are side-elevational views showing a sequence of a movement of the front lay drive of FIGS. 5A and 5B, in a waiting position in FIG. 6A and in a pivoted-away position in FIG. 6B.
Figure 6B:
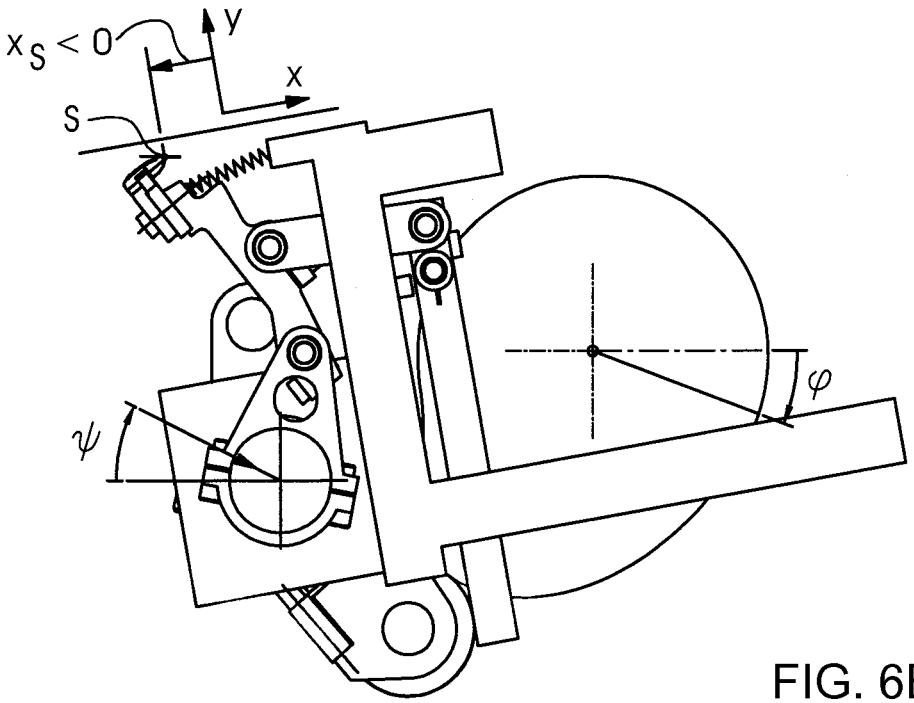

Starting from a waiting position, which is shown in FIG. 6A, the front lays 38 pivot away, are at the same time lowered in the process below a departing sheet 48 (FIG. 6B) and return to an initial position in order to align the next leading sheet edge. If a movement of a front lay tip S in a sheet running direction is considered, the current position of the front lay tip S is given by a coordinate $x_s$ in a fixed x,y coordinate system. In order to align the sheets, the front lays 38 are to be as completely stationary as possible ($x_s=0$; $dx_s/dt=0$). However, as a result of vibrations of the front lay shaft 40, they also move in the resting phase which is provided.

Figure 7:
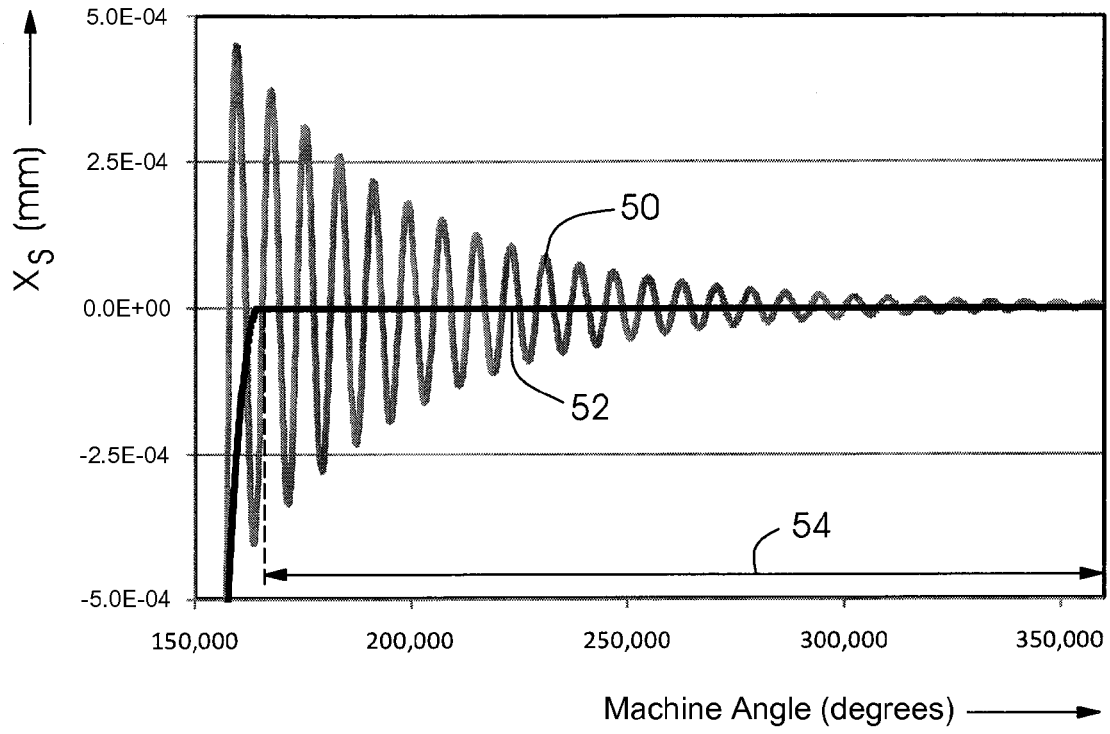
FIG. 7 is a graph showing a decay behavior of a front lay at 15,000 prints per hour.

FIG. 7 shows, by way of example, a typical decay curve for the coordinate $x_s$ of a front lay 38 (FIG. 5) at the free end of the front lay shaft 40 as a function of the machine angle. Firstly, a vibration loaded actual course 50 is shown which is explained by torsional vibrations of the front lay shaft 40 which occur. Secondly, an intended course 52 is shown which is achieved with a non-constant cam disk course according to the invention that is selected for 15,000 prints per hour (copies or sheets per hour). The maximum $x_{S,max}$ in the course $x_S(\phi)$ (machine angle $\phi$ in FIG. 4) can be used as a criterion for the dynamic behavior. As small a superelevation $x_{S,max}$ as possible is aimed for, for a precise alignment of the leading sheet edge. It can be seen clearly that the vibrations which occur without the use of the cam disk according to the invention are eliminated in an alignment phase 54.

Figure 8:
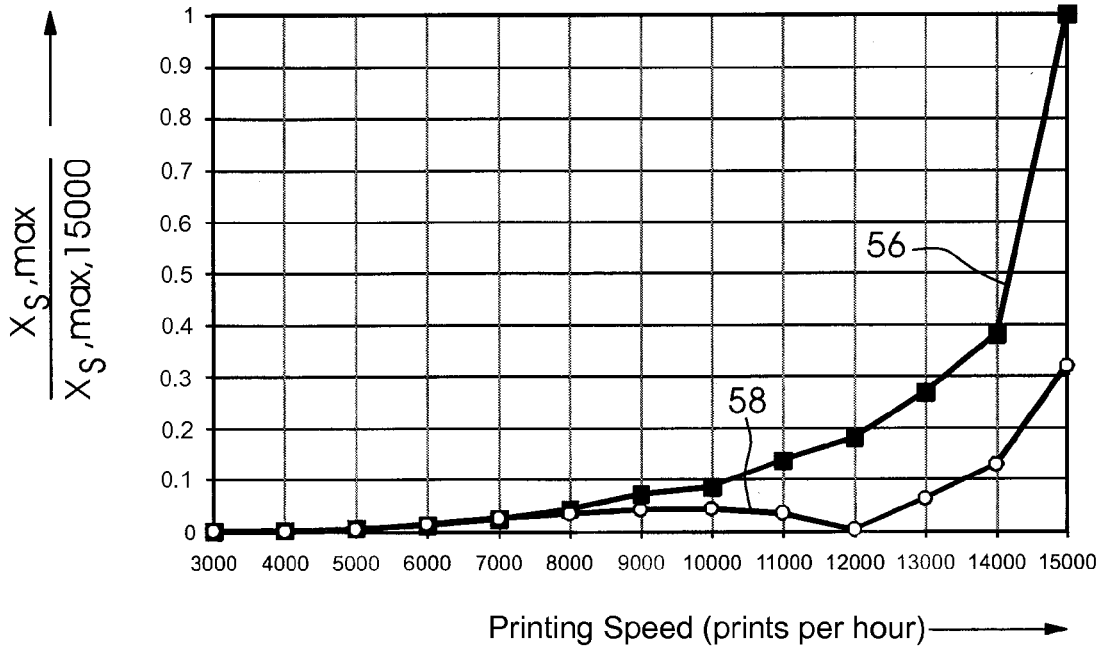
FIG. 8 is a graph showing a relative dynamic superelevation for various printing speeds.
Figure 9:
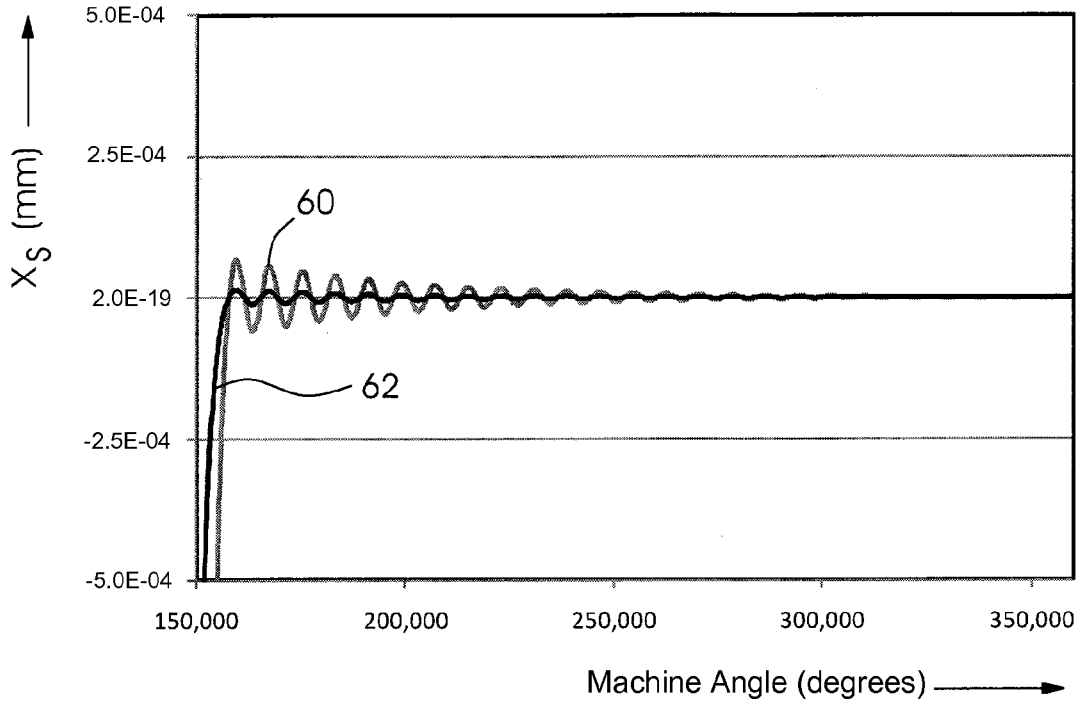
FIG. 9 is a graph showing decay curves for 12,000 prints per hour.

The operation without movement of the linear actuators 44 will first of all be described in greater detail for further explanation. FIG. 8 shows the dynamic superelevations of the front lay movement (front lay 38 in FIG. 2) for various printing speeds, shown in prints per hour. For an improved capability of comparing the values, the calculated superelevations $x_{S,max}$ have been related to the peak value $X_{S,max,15000}$ which occurs at 15,000 prints per hour. A first course 56 results if a cam disk 14 is used with a constant curvature course. A second course 58 results in the case of a cam disk with jumps 16 which are disposed in a targeted manner in the cam disk curvature. A printing speed of 12,000 prints per hour has been selected as a delivery speed of the drive system for the following quantitative calculations. It becomes clear from FIG. 8 that practically no dynamic superelevation of the course $x_S(\phi)$ occurs any more precisely at this printing speed if the drive which is proposed herein is used first of all without actuation of the linear actuators 44. The vibrations of the front lays are eliminated almost completely in the resting phase: FIG. 9 shows a first decay curve 60 if a cam disk 14 with a constant curvature course is used. In this illustration, this first decay curve 60 has clearly discernible vibration oscillations. Furthermore, a second decay curve 62 is shown in the case of a cam disk with jumps 16 which are disposed in a targeted manner in the cam disk curvature. The vibration oscillations of the first decay curve 60 are compensated for.

As a result of this principle, the vibration reducing action of the curvature jumps in the cam disk profile is lost at least partially if the printing speed deviates from the delivery speed of 12,000 prints per hour (FIG. 8, second course 58). This disadvantage can then be overcome by a suitable controller of the linear actuators 44.

The operation with an actuation of the linear actuators 44 will now be discussed in greater detail for the further more detailed explanation of the operation of the drive system according to the invention of the printing press according to the invention.

In principle, the actuated linear actuators 44 in the roller lever 20 perform identical stroke movements. It should be mentioned at this point that in principle the integration of a single actuator would be sufficient to achieve the kinematic function, but two actuators are used in this advantageous embodiment for concrete structural reasons and in order to avoid undesirable deformations of the roller lever 22. Furthermore, according to the invention, a cam disk is used having jumps in the curvature course (at a delivery speed of 12,000 prints per hour). As a result of the linear movement of the linear actuators 44 with corresponding deformation of the roller lever 22 in the solid body joint 46, an additional amount $\Delta\psi$ is added to the rotational angle $\psi$ (FIG. 6B) of the front lay shaft 40, which rotational angle results solely from the cam disk configuration. As a result of suitable control of the linear actuators 44, the jumps in the angular acceleration profile of the roller lever 22, which are produced at the delivery speed solely by the non-constant curvature course of the cam disk profile, are displaced temporally. This achieves a situation in which the vibration reducing jumps in the angular acceleration profile of the roller lever 22 take place at the correct instant in every operating state, in particular at every printing speed of the printing press.

Figure 10:
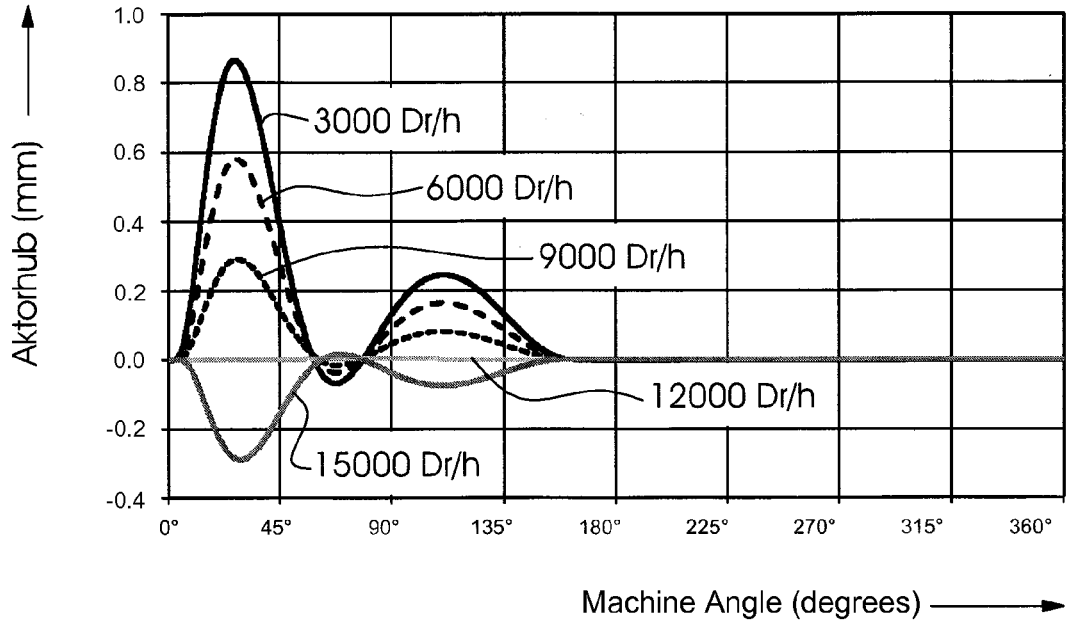
FIG. 10 is a graph showing courses of an actuator stroke for various printing speeds.

FIG. 10 shows stroke profiles of the linear actuators 44 at different printing speeds, in this case 3,000, 6,000, 9,000, 12,000 and 15,000 prints per hour, as a function of the machine angle. A constant actuator stroke 0 results for the printing speed of 12,000 prints per hour, since only the cam disk configuration ensures the almost complete reduction of disruptive vibrations of the front lays 38 in this operating state. In particular at high printing speeds, the strokes of the linear actuators 44 are only on the order of magnitude of a few tenths of a mm, with the result that a mechanically simple and maintenance free embodiment and realization of the active roller lever is advantageously possible by way of piezoelectric stack actuators.

Figure 11:
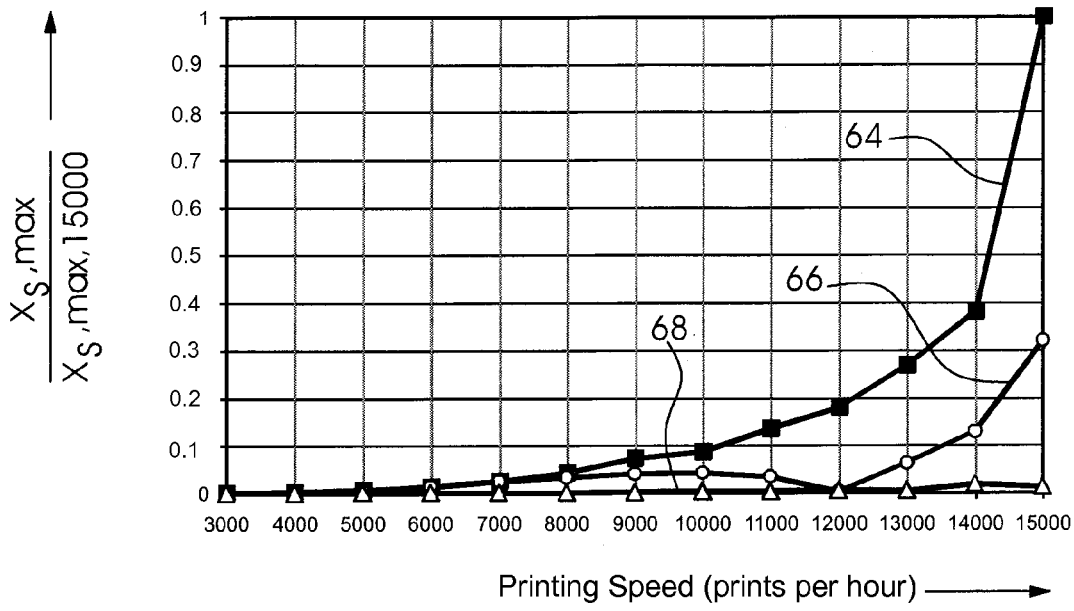
FIG. 11 is a graph showing a vibration reduction as a result of suitable control of the actuators (speed dependent input shaping)

FIG. 11 shows the operating behavior of the assembly of the printing press which is driven according to the invention using the dynamic superelevation $x_{S,max}$ in relation to the peak value $x_{S,max,15000}$ which occurs at 15,000 prints per hour, as a function of the printing speed in a speed range of from 3,000 prints per hour to 15,000 prints per hour. A third course 64 shows the operating behavior with a jump free cam disk in the case of inactive linear actuators. A fourth course 66 relates to the operating behavior with a cam disk according to the invention (constructed for 12,000 prints per hour) in the case of inactive linear actuators. A fifth course 68 represents the operating behavior with the cam disk according to the invention in the case of active linear actuators. It is to be noted in summary that the dynamic superelevation $x_{S,max}$ of the profile $x_S(\phi)$ of the positional coordinate $x_S$ is suppressed almost completely by the use of the linear actuators 44 in the entire speed range.

Figure 12:
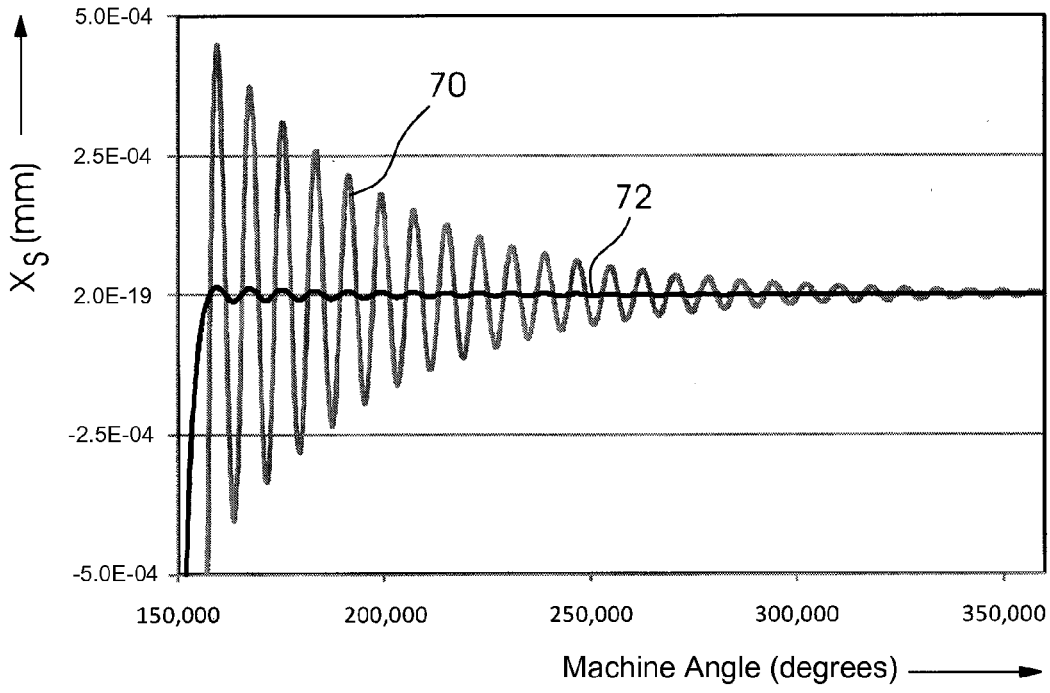
FIG. 12 is a graph showing a decay behavior in the case of a conventional drive with a cam disk without jumps and if the drive system according to the invention with an active roller lever is used.

In order to clarify the improvement which has been achieved, FIG. 12 shows the decay curve of the front lay 38 (FIG. 2) at 15,000 prints per hour as a function of the machine angle, firstly without (third decay curve 70) and secondly with the drive system according to the invention having a cam disk 14 with a constant curvature and an active roller lever 20 (fourth decay curve 72). In the order of magnitude shown, the third decay curve 70 has considerable oscillations, while the decay curve 72, which is obtained with the use of the drive system according to the invention, exhibits only slight oscillations which lie, in particular, below a tolerance threshold.

The invention claimed is:

1. A printing press, comprising:

an assembly; and a cam mechanism for moving at least one part of said assembly;

said cam mechanism including a roller lever with a cam roller, a cam disk having an axis and a cam being a peripheral line of said cam disk, said cam having a movement region and a closed curvature course within said movement region;

said cam roller and said movement region configured to permit said cam roller to roll repeatedly along said closed curvature course within said movement region with said cam rotating several times about said axis as the printing press prints;

said curvature course having jumps at some points in said curvature course; and said points of said curvature course lying on said cam and reducing or compensating for vibrations of said part of said assembly in resting phases of a movement of said part.

2. The printing press according to claim 1, wherein said cam mechanism includes an actuator for temporal displacement of jolts induced by said points to said at least one part of said assembly.

3. The printing press according to claim 2, wherein said actuator is a piezoelectric actuator connected to a roller lever controlled by said cam.

4. The printing press according to claim 2, which further comprises a control unit for actuating said actuator as a function of printing speed.

5. The printing press according to claim 1, wherein said cam mechanism is coupled to a main drive of the printing press.

6. The printing press according to claim 1, wherein two of said points of said curvature course lie on said cam at a spacing which is passed through during a multiple of half a vibration duration of said assembly when said cam is sensed by said cam roller with a relative movement with respect to said cam at a delivery speed of said cam.

7. The printing press according to claim 1, wherein the printing press is a sheet-fed printing press and said assembly is a front lay mechanism for bringing sheets into contact with a first printing unit.

* * * * *